US006547085B2

(12) United States Patent
Belisle

(10) Patent No.: US 6,547,085 B2
(45) Date of Patent: Apr. 15, 2003

(54) TRANSPORTABLE HOCKEY STICK RACK

(76) Inventor: Florent Belisle, 253, 9th Avenue, Asbestos, Quebec (CA), J1T 1T1

( * ) Notice: Subject to any disclaimer, the term of this patent is extended or adjusted under 35 U.S.C. 154(b) by 0 days.

(21) Appl. No.: 10/061,831

(22) Filed: Jan. 31, 2002

(65) Prior Publication Data

US 2002/0113030 A1 Aug. 22, 2002

(30) Foreign Application Priority Data

Feb. 2, 2001 (CA) ..... 2334053

(51) Int. Cl.[7] ..... A47F 7/00
(52) U.S. Cl. ..... 211/85.7; 211/4; 280/79.3
(58) Field of Search ..... 211/85.7, 60.1, 211/70.8, 70.2, 4; 280/79.3

(56) References Cited

U.S. PATENT DOCUMENTS 1,581,061 A * 4/1926 Johnston
1,678,353 A * 7/1928 Reach
2,262,298 A * 11/1941 Procter
2,753,189 A * 7/1956 Conroy et al.
3,147,988 A * 9/1964 Schairer
3,880,336 A * 4/1975 Demasson
4,126,327 A * 11/1978 Taber
4,181,221 A * 1/1980 Tennant ..... 211/64 X
4,461,385 A * 7/1984 Clouser ..... 211/4
5,797,612 A * 8/1998 Buccioni
6,431,627 B1 * 8/2002 Tomeny ..... 211/70.2 X

* cited by examiner

*Primary Examiner*—Robert W. Gibson, Jr.
(74) *Attorney, Agent, or Firm*—Eric Fincham

(57) ABSTRACT

A storage rack for hockey sticks comprising a frame, a base, and at least one transversely extending support member, a retaining member being pivotably connected proximate said support member and being moveable between an open position to permit hockey sticks to be placed in a storage position on the rack and a closed position wherein the retaining member prevents removal of the hockey sticks from the storage rack. The storage rack is preferably transportable and includes a storable stand.

12 Claims, 5 Drawing Sheets

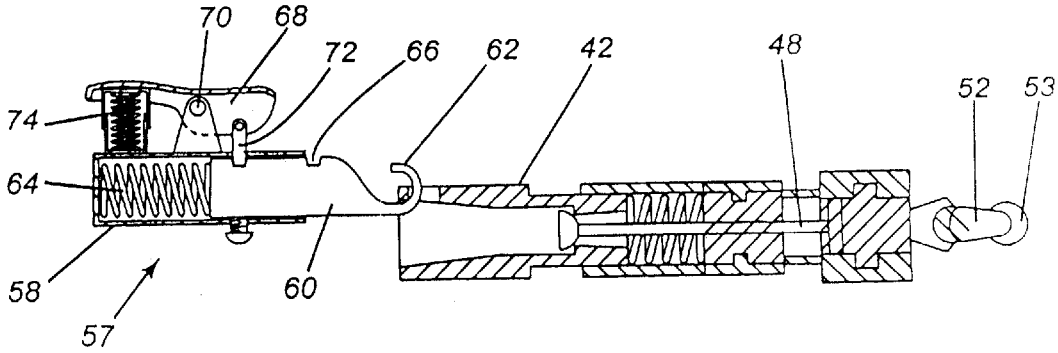
Fig- 10a
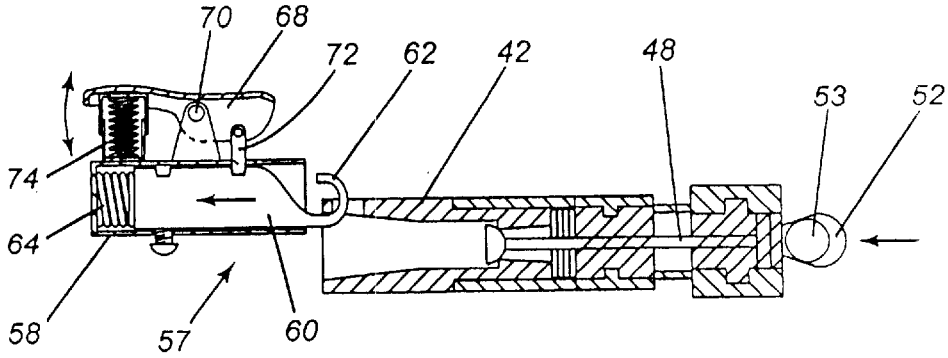
Fig- 10b
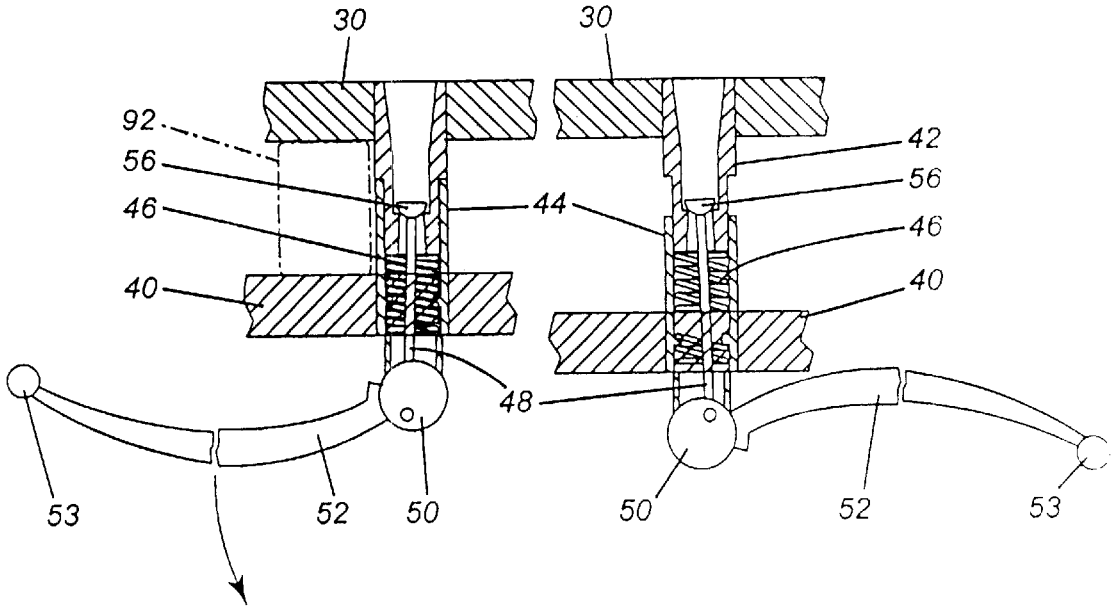
Fig- 11a
Fig- 11b

TRANSPORTABLE HOCKEY STICK RACK

FIELD OF THE INVENTION

The present invention relates to a storage rack and more particularly, relates to a storage rack for hockey sticks.

BACKGROUND OF THE INVENTION

Hockey is a popular sport and is widely practiced in many different parts of the world. Similar to football, the sport of hockey requires a great deal of equipment and the storage of the same is always a problem. One of the pieces of equipment which requires storage is the hockey stick. At the present time, little regard is given to this problem and the sticks are often stored in a container such as a garbage container and/or left lying around the dressing rooms and the benches. As such, they present a hazard and are also subject to damage and/or loss.

There have been proposals in the art for overcoming this problem. Thus, reference may be had to Canadian application No. 2,278,063 which discloses a rack which is suitable for a dressing room or the like. The rack is designed to be fixed in place.

For many amateur teams, the hockey sticks must be transported from one location to another. As such, it would be desirable to have a rack which can retain a plurality of hockey sticks and which rack would be suitable for transporting the sticks from one location to another.

SUMMARY OF THE INVENTION

It is an object of the present invention to provide a storage rack for hockey sticks and the like.

It is a further object of the present invention to provide a storage rack for hockey sticks and the like and which storage rack may be easily moved from one location to the other.

It is a further object of the present invention to provide a storage rack suitable for storing hockey sticks and the like and which rack is designed to securely hold and retain the hockey sticks.

According to one aspect of the present invention, there is provided a storage rack for hockey sticks each having a shaft and a blade, the storage rack comprising a pair of uprights, a base, at least one support member extending transversely between the uprights, a retaining member operatively associated with the support member, the retaining member being movable between an open position wherein the hockey sticks may be placed in a storage position against the support member and a closed position wherein the retaining member retains the shafts of hockey sticks placed between the retaining member and the support member.

The storage rack may be made of any suitable material and/or combinations thereof. Thus, it can be manufactured of a metallic material or alternatively, may be formed of various plastic materials. Naturally, various components can be formed of different materials.

The storage rack is preferably easily transportable and to this end, there are provided wheels to permit the movement of the same. In a preferred embodiment, a pair of wheels are provided at the extremities of the uprights. However, other arrangements could be utilized including having more than two wheels.

In the preferred embodiment, the rack also employs a movable stand which is operative to lift the rack from the ground proximate the wheels. As such, the storage rack will then be stable when it is designed to stay in one place. The stand is movable into and out of a stored position and an operative position.

The rack includes means for accepting and retaining the hockey sticks. Preferably, there is provided means for clamping the hockey sticks in place to prevent movement thereof, particularly during the transporting operation.

In one embodiment, the storage rack may be configured such that two or more such racks may be secured together and then transported as a single unit.

BRIEF DESCRIPTION OF THE DRAWINGS

Having thus generally described the invention, reference will be made to the accompanying drawings illustrating an embodiment thereof, in which:

FIGS. 10*a* and 10*b* are cross sectional views of the rack connecting device in an open and close position respectively; and FIGS. 11*a* and 11*b* are cross sectional views of the locking device for the retaining member in closed and open positions respectively.

DESCRIPTION OF THE PREFERRED EMBODIMENTS

Figure 1:
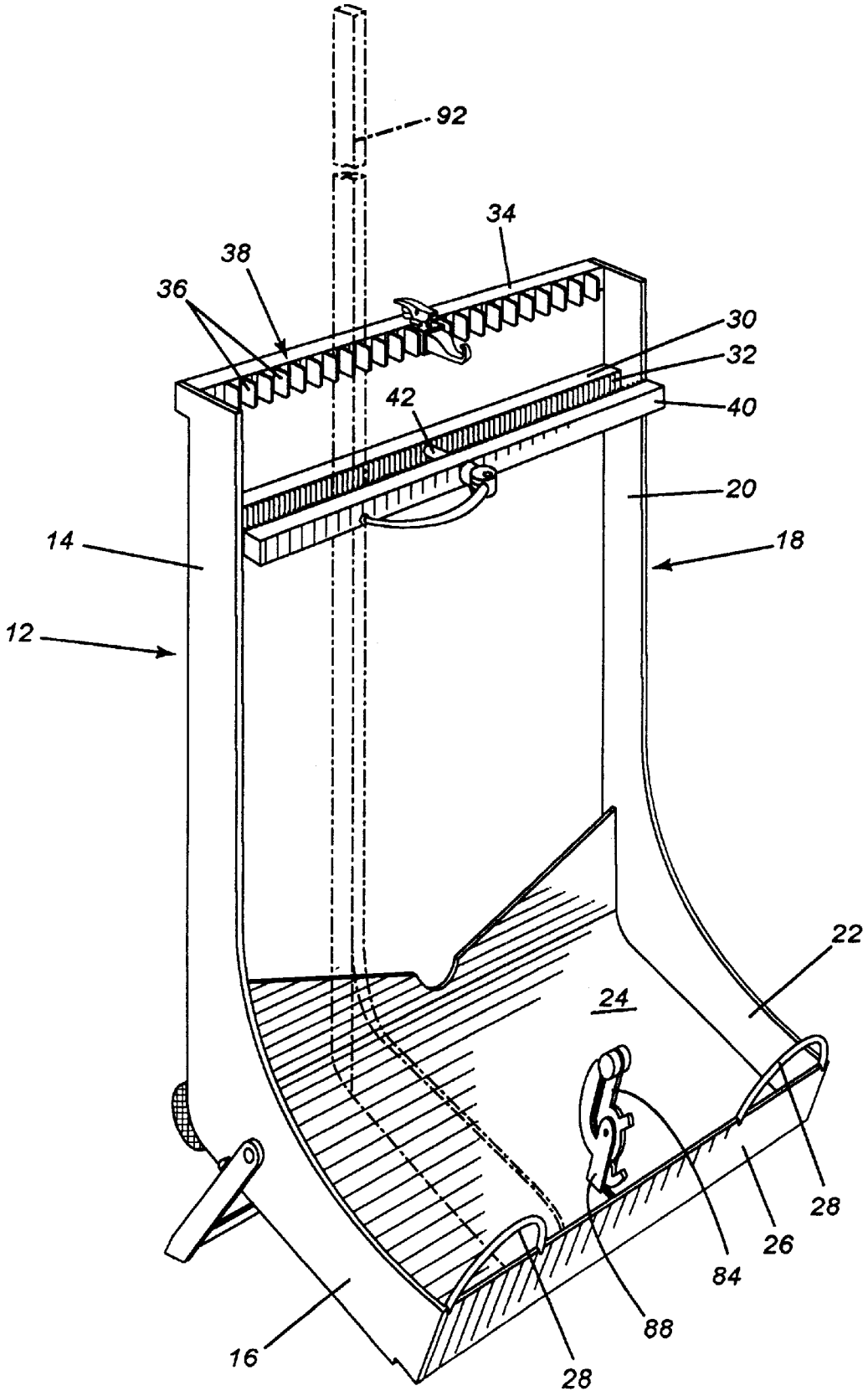
FIG. 1 is a perspective view illustrating an embodiment of a storage rack for hockey sticks.
Figure 2:
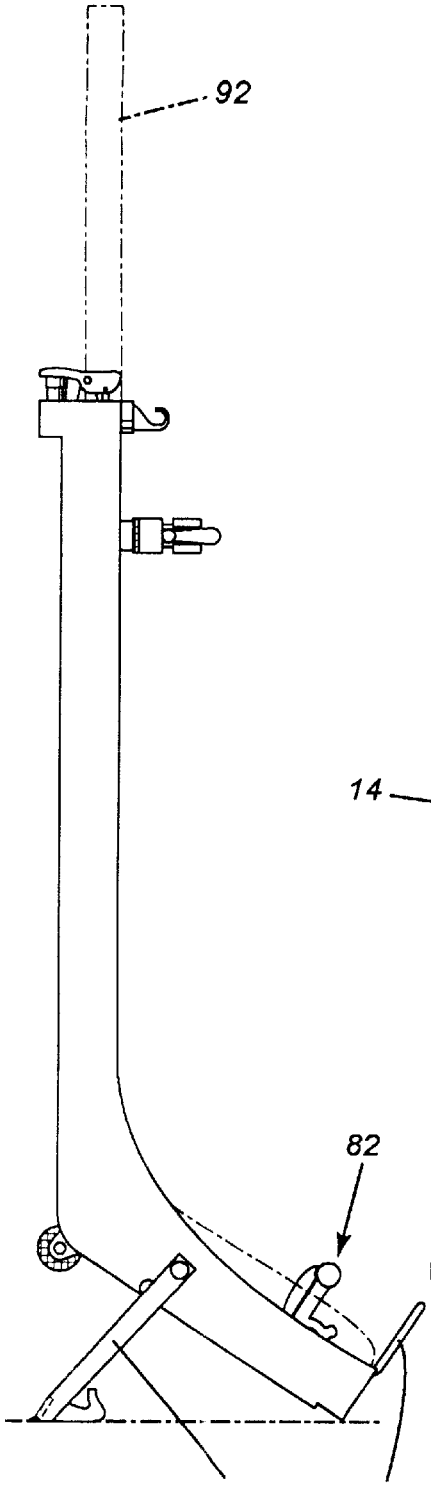
FIG. 2 is a side elevational view thereof.

Referring to the drawings in greater detail and by reference characters thereto, there is illustrated a hockey storage rack according to the present invention which hockey storage rack is generally designated by reference numeral 10.

Hockey storage rack 10 has a pair of uprights 12 and 18 each having a vertical portion 14 and 20 respectively and a lower h horizontal portion 16 and 22 respectively. Extending between uprights 12 and 18 is a base 24 and an end wall 26. Base 24, as may be seen in FIG. 1, has a upwardly curved configuration. A pair of handles 28 are provided on an upper marginal edge of end wall 26.

Extending between vertical portions 14 and 20 of uprights 12 and 18 respectively is a transversally extending support member 30. Transversal support member 30 is provided with a cushioned face 32.

There is also a second upper support member generally designated by reference numeral 34 and which includes a plurality of outwardly extending dividers 36 to thereby provide a plurality of pockets 38 designed to receive the shaft of a hockey stick.

Figure 3:
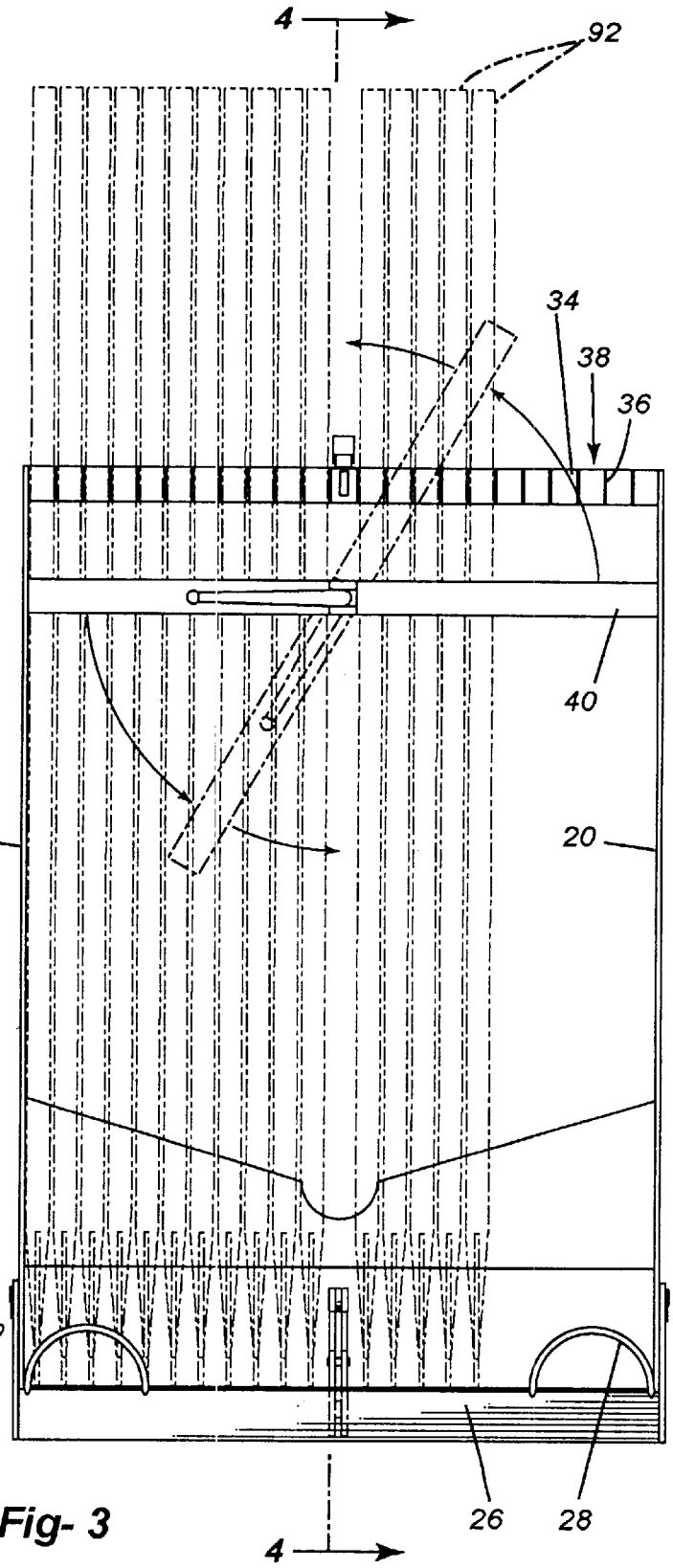
FIG. 3 is a front elevational view thereof showing a plurality of hockey sticks in a stored position.
Figure 4:
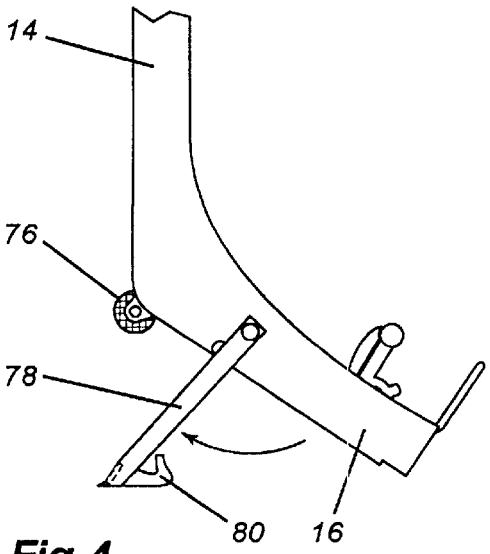
FIG. 4 is an enlarged side elevational view of the lower portion of the storage rack and associated stand.
Figure 5:
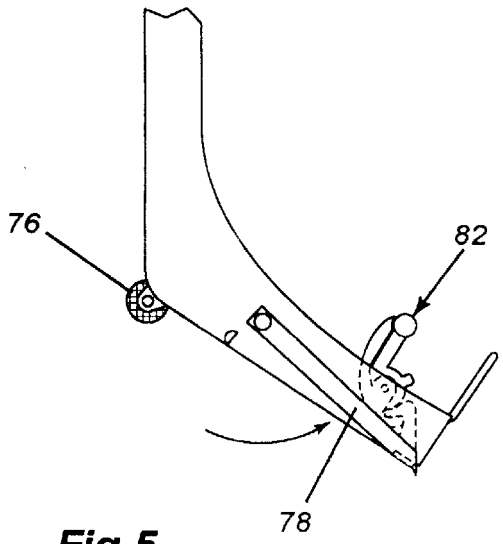
FIG. 5 is a view similar to FIG. 4 showing the stand in a stored position.
Figure 6:
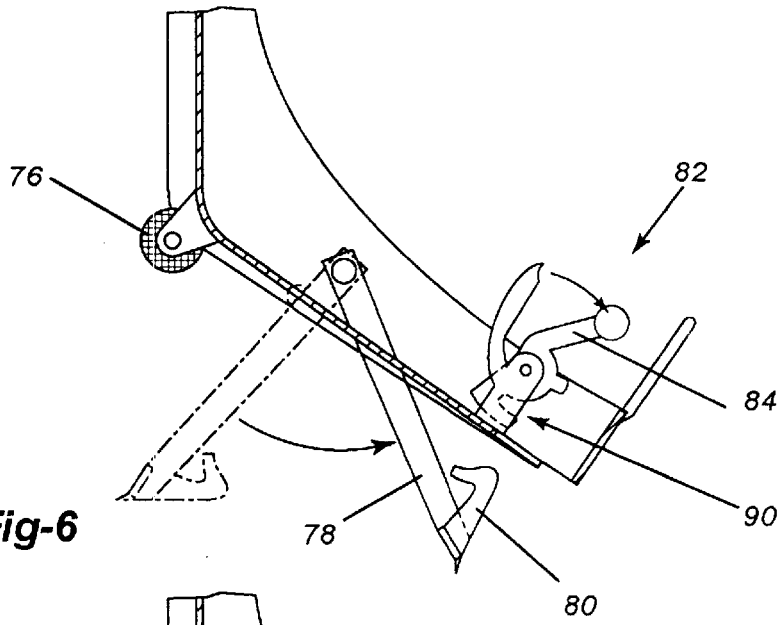
FIG. 6 is a cross sectional view, partially in cut-away, showing the bottom portion of the storage rack and associated stand.
Figure 7:
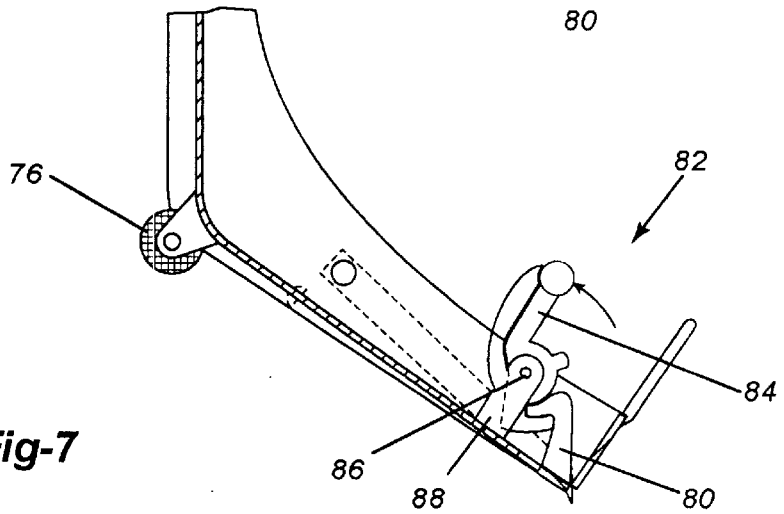
FIG. 7 is a cross sectional view similar to FIG. 6 showing the stand in a stored position.
Figure 8:
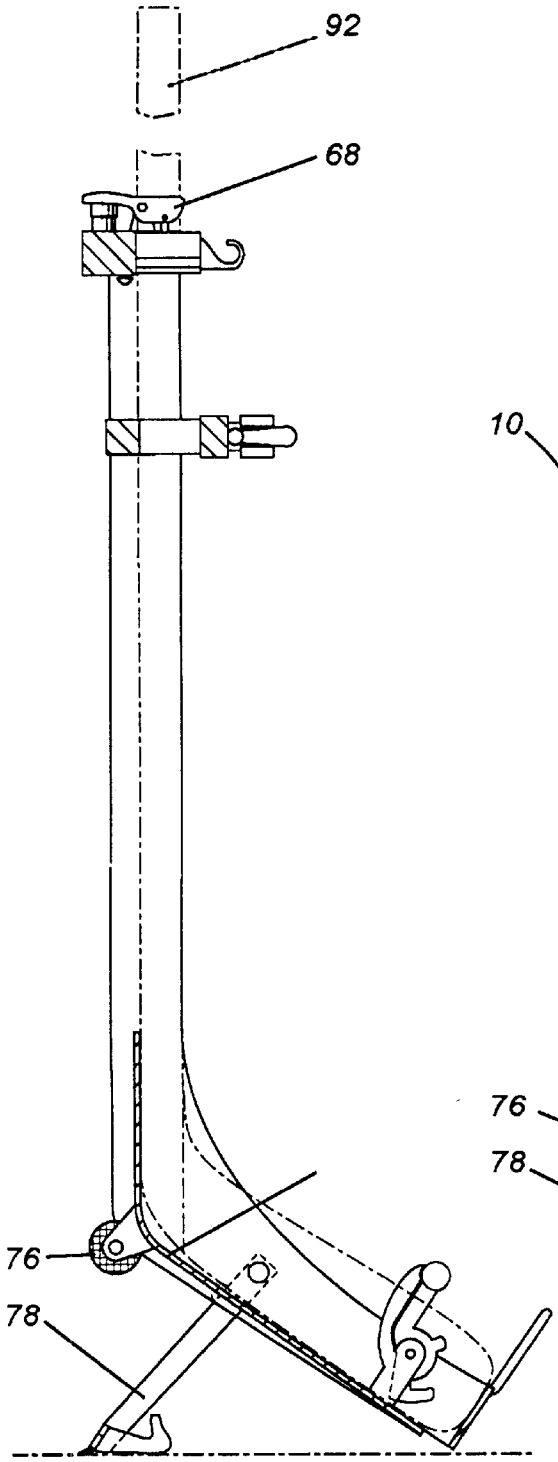
FIG. 8 is a cross sectional view, partially in cut-away, of a storage rack according to the present invention.

Associated with transversely extending support member 30 is a retaining member 40 which is pivotably mounted on a shaft 42. Thus, retaining member may be pivoted from a retaining position such as seen in FIG. 1 and 3 to a vertical out-of-the-way position as shown in dotted lines in FIG. 3.

The operation of retaining member 40 is best illustrated in FIGS. 10 and 11 and reference will now be had thereto. An outer shaft 44 is secured to retaining member 44 and designed to rotate about shaft 42. A coil spring 46 seats between shaft 42 and retaining member 40 within outer shaft 44 to bias retaining member 40 to an open position. A rod 48 having a seat 56 abutting against an inner portion of shaft 42 is operatively connected to a cam member 50 and which can be turned by means of locking handle 52 to thereby move retaining member 40 into a locked position as shown in FIG. 11*a*. It will be noted that locking handle 52 has a ball 53 formed at a distal end thereof and which is designed to seat within a recess formed in retaining member 40.

A rack connection device generally designated by reference numeral 57 is utilized to connect a first hockey storage rack to a second storage rack. As may be best seen in FIGS. 10*a* and 10*b*, rack connection device 57 includes a housing 58 having therein a slidable hook member 60 with a hook 62 formed at one end thereof. A coil spring 64 mounted within housing 58 biases hook member 60 outwardly. A recess 66 is provided in an upper surface of hook member 60.

Figure 9:
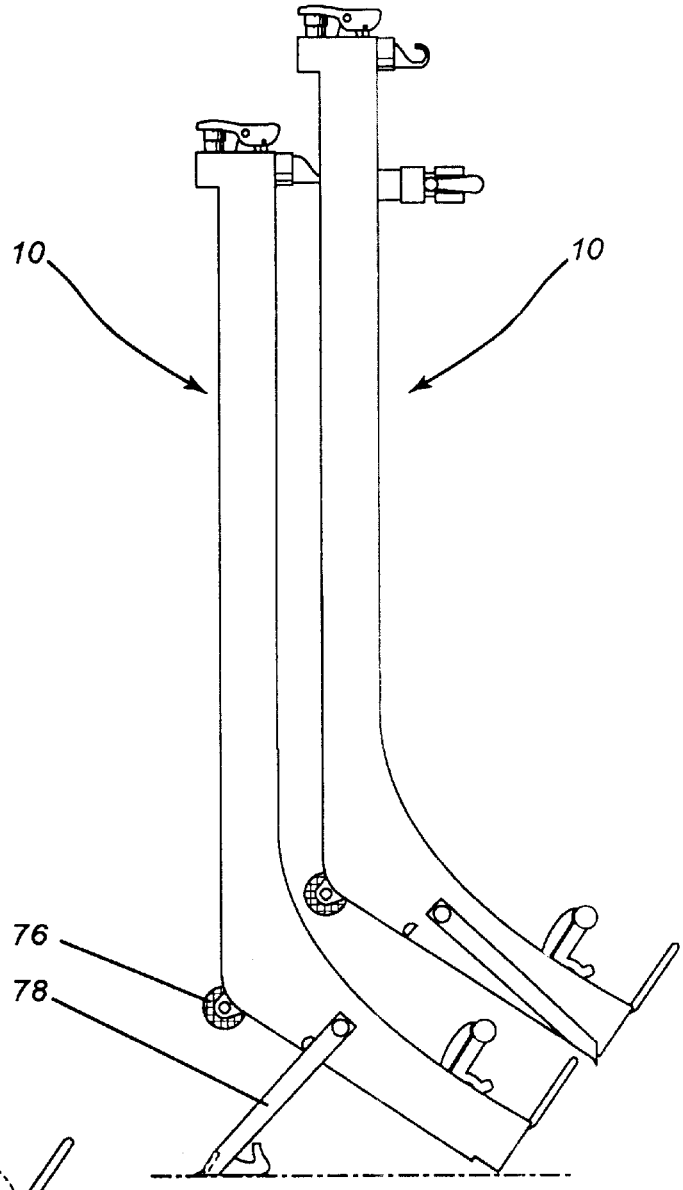
FIG. 9 is a side elevational view showing the connection of two storage racks together.

A lever 68 is pivotably mounted at pivot point 70 and has at one end a locking pin 72 which extends through an aperture in housing 58 and is designed to engage recess 66 to maintain hook member 60 in a closed position. At the opposite end, there is provided a coil spring 74 which biases lever 68 to a position forcing locking pin 72 through the aperture formed in housing 58. As may be seen in FIG. 10*a* and 10*b*, hook 62 can engage a portion of shaft 42 to secure two racks together as illustrated in FIG. 9.

Storage rack 10 also preferably includes wheels 76 to provide for easy transport of the rack from one location to another. In order to provide stability when in a fixed position, storage rack 10 includes a stand 78. As may be seen in FIGS. 4, 6, 8 and 9, stand 78 includes a hook 80 for reasons which will become apparent therein below.

A stand locking device generally designated by reference numeral 82 includes a pivotable arm 84 connected at pivot point 86 to pivot arm supports 88. At one end pivotable arm 84 includes a recess 90 which is designed to receive and engage hook 80 on stand 78. Thus, as may be seen in FIGS. 4 to 7, pivotable arm 84 will retain stand 78 in a stored out-of-the-way position when required.

The device is designed to receive hockey sticks 92 with the blade of the hockey stick resting on base 24 and the shaft fitting within the pocket 38 formed between the dividers 36. In placing the hockey stick 92 into position, retaining member 40 is moved to a vertical position as shown in FIG. 3. When all the sticks are in position, retaining member 40 is pivoted to a horizontal position and locking handle 52 moved from the position shown in FIG. 11*b* to that shown in 11*a* whereby retaining member 40 moves against the shaft of hockey stick 92 to retain the same in a secure position.

It will be understood that the above described embodiment is for purposes of illustration only and that changes and modifications may be made thereto without departing from the spirit and scope of the invention.

I claim:

1. A storage rack for hockey sticks each having a shaft and a blade, said storage rack comprising:

a pair of uprights;

a base having an arcuate upper surface extending between said uprights to receive and support the blade of a hockey stick;

at least one support member extending transversely between said uprights; and a retaining member operatively associated with said support member, said retaining member being movable between an open position wherein said hockey sticks may be placed in a storage position against said support member and a closed position wherein said retaining member retains the shafts of hockey sticks placed between said retaining member and said support member.

2. The storage rack of claim 1 further including a second support member extending between said uprights, said second support member having a plurality of pockets formed therein, each of said pockets being arranged to receive a shaft of a hockey stick.

3. The storage rack of claim 1 wherein said base includes wheels mounted on a lower portion thereof to permit rolling movement of the storage rack.

4. The storage rack of claim 3 further including a support stand, said stand being movable between an operative support position and a storage position.

5. The storage rack of claim 1 further including locking means associated with said retaining member to lock said retaining member in a closed position against said support member.

6. The storage rack of claim 5 wherein said retaining member is pivotable with respect to said support member such that said retaining member may be moved into a vertical position to permit placement of said hockey sticks in a storage position and a horizontal closed position to retain the shafts of the hockey sticks between said retaining member and said support member.

7. The storage rack of claim 6 wherein said retaining member is cam operated.

8. The hockey rack of claim 7 further including a handle associated with said cam, said hockey rack having means for storing said locking handle.

9. The storage rack of claim 2 wherein said retaining member and said support member have cushioned facing surfaces.

10. The storage rack of claim 1 further including means for connecting said storage rack to a second storage rack for transport.

11. A storage rack for hockey sticks each having a shaft and a blade, said storage rack comprising:

a pair of uprights;

a base;

at least one support member extending transversely between said uprights; and a retaining member operatively associated with said support member, said retaining member being movable between an open position wherein said hockey sticks may be placed in a storage position against said support member and a closed position wherein said retaining member retains the shafts of hockey sticks placed between said retaining member and said support member, said retaining member being pivotable between said open and closed positions, said retaining member being cam operated.

12. A storage rack for hockey sticks each having a shaft and a blade, said storage rack comprising:

a pair of uprights;

a base;

at least one support member extending transversely between said uprights;

a retaining member operatively associated with said support member, said retaining member being movable between an open position wherein said hockey sticks may be placed in a storage position against said support member and a closed position wherein said retaining member retains the shafts of hockey sticks placed between said retaining member and said support member; and means for interconnecting said storage rack to a second storage rack for transport.

* * * * *